United States Patent [19]

Dorosz et al.

[11] 4,312,282

[45] Jan. 26, 1982

[54] POSITIONING APPARATUS

[75] Inventors: Adolph S. Dorosz, Beverly; John F. Martin, S. Essex, both of Mass.

[73] Assignee: USM Corporation, Farmington, Conn.

[21] Appl. No.: 132,072

[22] Filed: Mar. 20, 1980

Related U.S. Application Data

[63] Continuation of Ser. No. 8,503, Feb. 1, 1979, abandoned.

[51] Int. Cl.[3] ..... D05B 21/00

[52] U.S. Cl. ..... 112/121.12

[58] Field of Search ..... 112/121.15, 121.11, 112/121.12, 121.29, 118, 84

[56] References Cited

U.S. PATENT DOCUMENTS

| | | | |
|---|---|---|---|
| 2,837,046 | 6/1958 | Carson et al. | 112/84 X |
| 3,611,819 | 10/1971 | Muller et al. | 74/89.22 |
| 3,750,186 | 7/1973 | Sakamoto | 112/121.12 |
| 3,771,477 | 11/1973 | Conner, Jr. | 112/121.12 |
| 3,830,175 | 8/1974 | Levor | 112/121.12 |
| 3,970,016 | 7/1976 | Yanikowski | 112/121.12 |

FOREIGN PATENT DOCUMENTS

| | | | |
|---|---|---|---|
| 709621 | 6/1954 | United Kingdom | 112/121.12 |
| 745474 | 2/1956 | United Kingdom | 112/121.12 |
| 847545 | 9/1960 | United Kingdom | 112/121.12 |
| 1108141 | 4/1968 | United Kingdom | 112/121.15 |

*Primary Examiner*—H. Hampton Hunter

*Attorney, Agent, or Firm*—William F. White

[57] ABSTRACT

A rigid, lightweight positioning system is disclosed for use with a high speed sewing machine. The positioning system includes a rigid, lightweight frame that is slidably mounted in a predefined plane. The frame is driven within the plane by a remotely located motor. A carriage is slidably mounted on the frame so as to move in a direction transverse to the direction of movement of the frame itself. This carriage is driven along its axis by a second remotely located motor. The overall arrangement of the elements within the positioning system is such as to minimize the introduction of vibration at the point of sewing.

22 Claims, 15 Drawing Figures

POSITIONING APPARATUS

This is a continuation of application Ser. No. 8,503, filed Feb. 1, 1979, now abandoned.

FIELD OF THE INVENTION

This invention relates to apparatus for positioning an article relative to an operative tool. In particular, this invention relates to the positioning of an article relative to the sewing needle of an automated sewing machine.

BACKGROUND OF THE INVENTION

The need to position an article rapidly and accurately with respect to an operative tool is a basic requirement in much of today's automated machinery. The approaches which have been taken to accomplish this end have varied depending on the type of operative tool involved and the type of article which is to be positioned. For instance, in automated sewing the operative tool is usually a cyclically operated sewing needle which moves into and out of an article that is positioned thereunder. The article may be either a number of separate pieces of material that are to be joined together or a separate piece of material requiring a decorative pattern. In any event, the article is positioned relative to the sewing needle by a positioning apparatus. This apparatus preferably moves the article only during that portion of the sewing cycle when the needle is withdrawn from the material. This places some rather stringent timing requirements on the positioning apparatus for high speed sewing. These stringent timing requirements usually include the need to quickly change the direction in which the article is being fed underneath the needle. This latter requirement is usually met by implementing two separate directional motions which combine to define any particularly desired feed direction for the next stitch. For instance, separate motions in an X and Y direction within a cartesian coordinate system will accomplish such a feed direction capability. These separate motions are commonly referred to as occurring with respect to X and Y axes.

The need to simultaneously implement motion along two separate axes at relatively high speed has resulted in various types of positioning apparatus. These have included mechanisms which superimpose the motion occurring along one axis with respect to the motion occurring along the second axis. These mechanisms have by their very nature often been quite complex. These mechanisms have moreover sometimes introduced undesirable vibrations into the overall positioning of the article relative to the sewing needle.

It is to be appreciated that while certain drawbacks have been herein discussed relative to positioning apparatus for sewing machines, the same considerations are also equally applicable to certain other automatic machinery. To this extent, the invention which will be hereinafter described is also broadly applicable to automatic machinery in general.

OBJECTS OF THE INVENTION

It is an object of this invention to provide an improved system for positioning an article relative to an operative tool.

It is another object of this invention to provide an improved system for rapidly positioning an article relative to an operative tool during brief periods of time that are dictated by the operation of the tool.

It is a still further object of this invention to provide a positioning system which allows for accurate high speed sewing by an automated sewing machine.

SUMMARY OF THE INVENTION

The above and other objects are achieved according to the present invention by providing a rigid, lightweight positioning system. The positioning system includes a rigid, lightweight frame that is slidably mounted in a predefined plane. The frame is driven within the plane by a remotely located motor. A carriage is slidably mounted on the frame so as to move in a direction transverse to the direction of movement of the frame itself. This carriage is driven along its axis by a second remotely located motor. The overall arrangement of the elements within the positioning system is such as to minimize the introduction of vibration at the point of sewing.

BRIEF DESCRIPTION OF THE DRAWINGS

The above and other features of the invention will now be particularly described with reference to the accompanying drawings, in which.

DESCRIPTION OF THE PREFERRED EMBODIMENT

Figure 1:
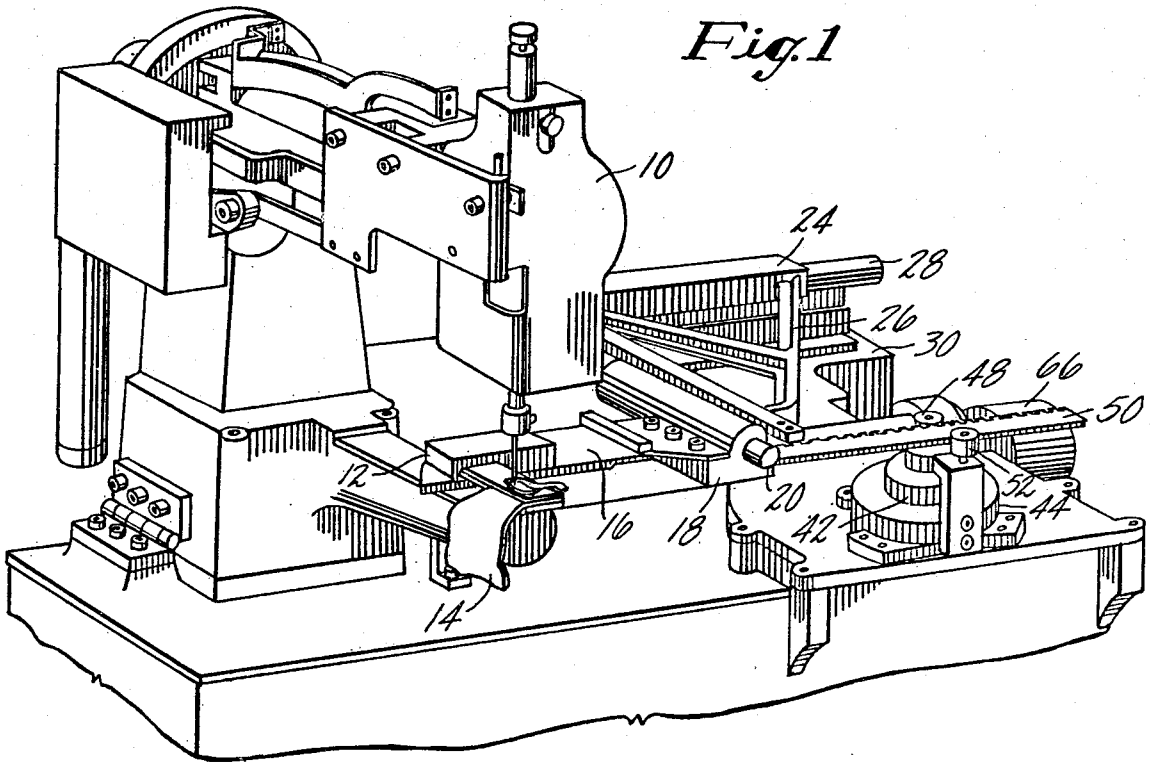
FIG. 1 is a perspective view of a sewing machine having apparatus for positioning an article that is to be sewn.

Referring to FIG. 1, a sewing machine 10 is generally illustrated in conjunction with certain positioning apparatus. The positioning apparatus includes a clamp mechanism 12 which holds an article 14 that is to be sequentially positioned underneath the needle of the sewing machine 10. The clamp mechanism 12 is preferably of the type disclosed in commonly assigned U.S. patent application Ser. No. 867,927, in the names of Dorosz et al, filed on Jan. 9, 1978, and entitled "Apparatus for Holding Work in a Sewing Machine". The clamp mechanism is attached to an arm 16 which is in turn attached to a carriage 18. The carriage 18 is mounted for movement along the length of a cylindrical axis member 20.

Figure 2:
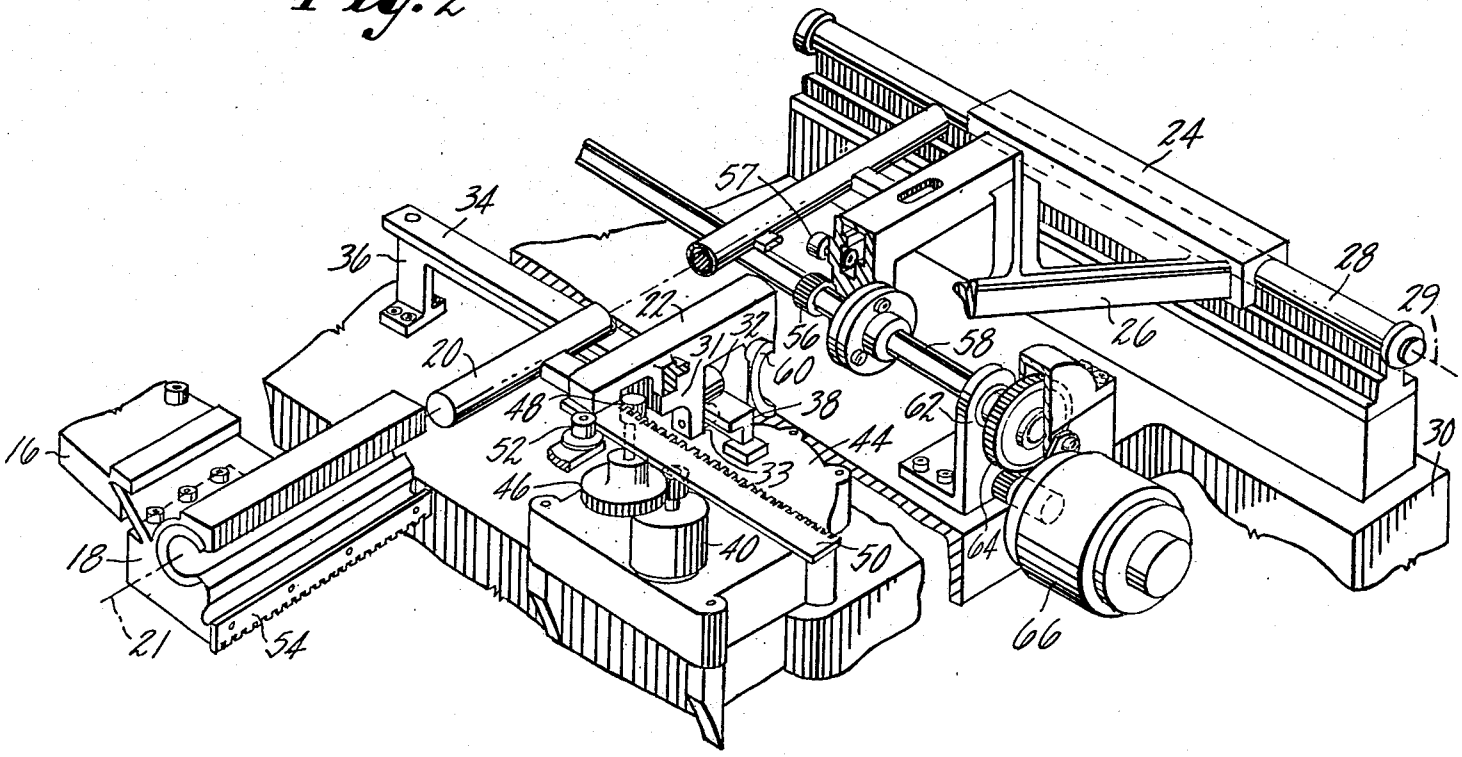
FIG. 2 is a perspective view of the apparatus for positioning the article that is to be sewn.
Figure 5:
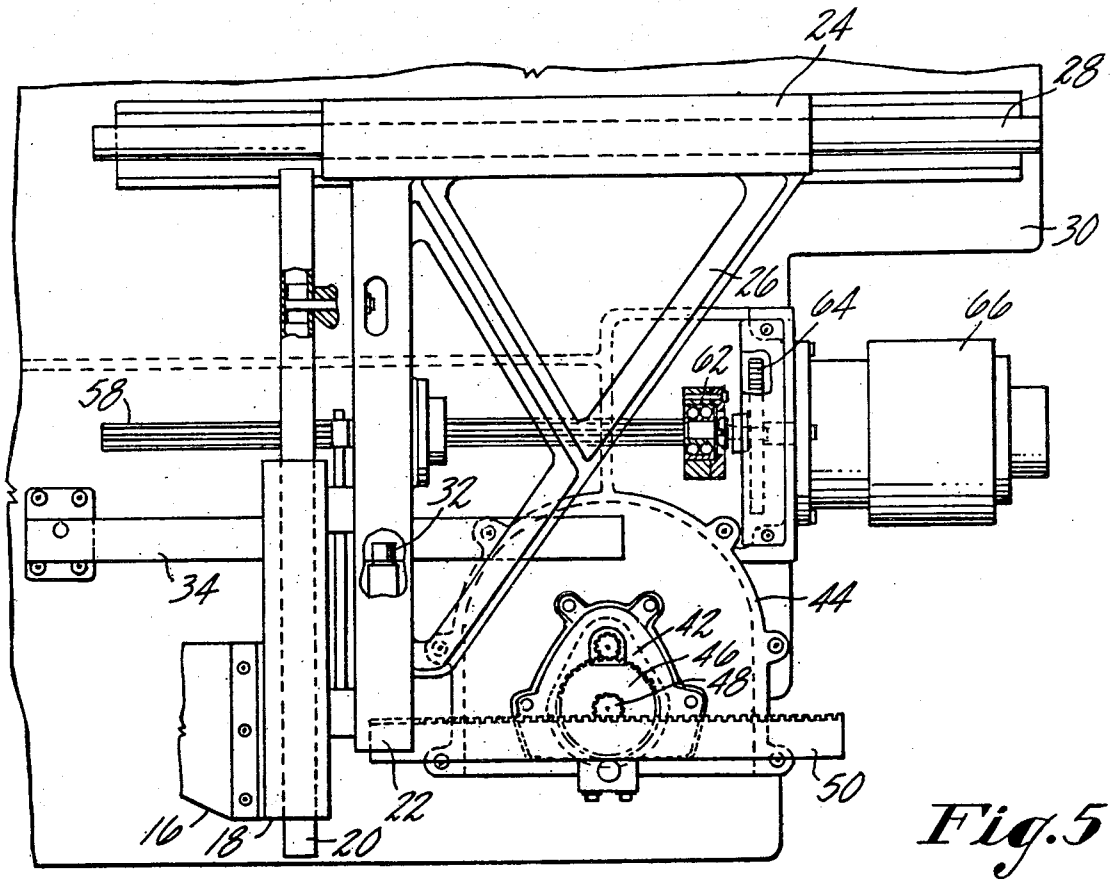
FIG. 5 is an overall top view of the positioning apparatus.

Referring to FIG. 2, the carriage 18 is illustrated in exploded fashion relative to the cylindrical axis member 20. The cylindrical axis member 20 is seen to be attached to a beam 22 of an L-shaped lightweight frame comprising beams 22 and 24. The L-shaped lightweight frame futhermore comprises a Y-shaped bracing member 26. Both the L-shaped and the Y-shape are partially broken away in FIG. 2. A more complete showing of the L-shape and the Y-shape can be appreciated from a top view of the positioning apparatus as shown in FIG. 5. The entire lightweight frame comprising beams 22 and 24 plus the Y-shaped bracing member 26 is preferably fabricated from a lightweight material such as aluminum.

The lightweight frame is mounted for movement along a linear guide member 28 which is in turn mounted to a base 30. The base 30 is broken away in FIG. 2, but can be more fully appreciated by referring to FIG. 1. It is to be noted that the base 30 is relatively massive and serves as an eventual common base for all positioning elements. Referring again to FIG. 2, the lightweight frame is seen to have further support mounting structure comprising a downwardly extending portion 31 of the beam 22. The downwardly extending portion 31 has a pair of cylindrical rollers 32 and 33 mounted thereon. The rollers 32 and 33 engage the top and bottom surfaces of a planar guide 34. The planar guide 34 is at a height above the base 30 that is established by a pair of vertical supports 36 and 38. The resulting height that is established for the lightweight frame is such as to preferably define a particular plane of movement for the frame. This plane of movement is preferably orthogonal to the needle of the sewing machine 10.

In accordance with the invention, the clamped article 14 lies in a plane passing through the central axis 21 of the cylindrical axis member 20 as well as through the central axis 29 of the linear guide member 28. This is accomplished structurally by attaching the arm 16 to the carriage 18 in such a manner as to define a position for the clamping mechanism 12 which ultimately produces a clamped article 14 in a plane passing through the central axis 21 of the cylindrical axis member 20. The lightweight frame is moreover configured so as to place the central axis 29 of the linear guide member 28 in this same plane. This is accomplished structurally by causing the center of the complementary interior guide surface within the beam 24 to be coplanar with the central axis 21 of the cylindrical axis member 20. In this manner, the clamped portion of the article to be sewn will always lie in the plane of the imparted X and Y movements which occur along the central axes of the cylindrical axis member 20 and the linear guide 28.

The lightweight frame is moved along the guide member 28 and the planar guide 34 by virtue of a motor 40. The motor 40 is actually contained within appropriate housing 42 such as shown in FIG. 1. The housing 42 is mounted to an elevated base 44 which is in turn affixed to the base 30. The motor 40 has associated gearing 46 which drives a pinion 48 which in turn drives a rack 50. The rack 50 is maintained in engagement with the pinion 48 by a roller 52. One end of the rack 50 is connected to the beam 22 of the lightweight frame. In this manner, the rotational drive of the motor 40 is operative to ultimately displace the lightweight frame.

Having discussed the overall movement of the lightweight frame, it is now appropriate to turn to the relative movement of the carriage 18. It will be remembered that the carriage 18 is mounted for movement along the cylindrical axis member 20 which is in turn affixed to the beam 22 of the lightweight frame. The carriage 18 is seen to include a rack 54 which normally engages a pinion 56. The engagement of the rack 54 with the pinion 56 is normally maintained by a roller 57. The pinion gear 56 is driven by a spline shaft 58 in a manner which will be described hereinafter. The spline shaft 58 is rotatably supported within a lower portion 60 of the beam 22. The spline shaft 58 is furthermore rotatably supported within a mounting 62 that is secured to the base 30. Gearing 64 at the end of the spline shaft 58 is engagably driven by a motor 66. It is to be noted that the motor 66 is mounted in a conventional manner to the massive base 30 so as to thereby minimize any motor vibration. It is thus to be appreciated that the rotational motion from the motor 66 is imparted to the spline shaft 58 which ultimately produces a linear motion of the carriage 18 along the cylindrical axis 20.

Figure 3:
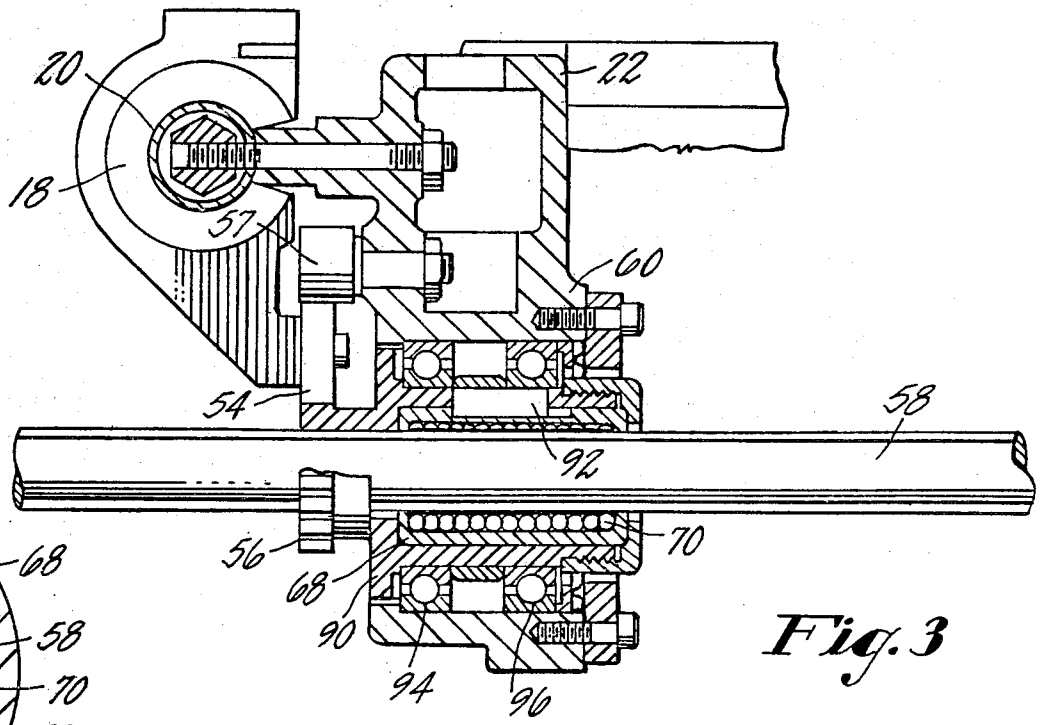
FIG. 3 illustrates, in further detail, a portion of the positioning apparatus.
Figure 4:
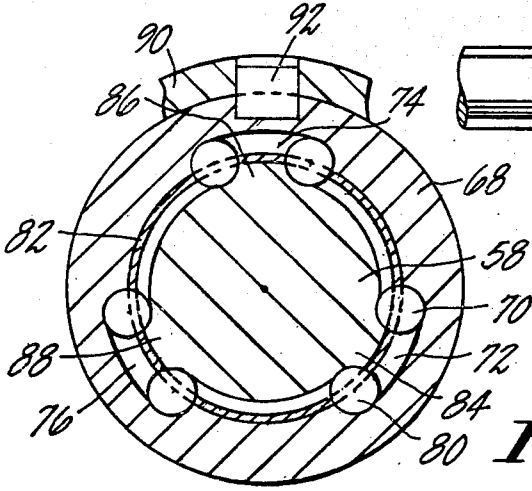
FIG. 4 illustrates in still further detail, a portion of the positioning apparatus.

Referring to FIG. 3, the rotatable mounting of the spline shaft 58 within the lower portion 60 of the beam 22 is illustrated in detail. The lower portion 60 of the beam 22 is broken away so as to clearly show the rotational mounting of the shaft. The spline shaft 58 is seen to be suspended within a cylindrical collar 68 by a plurality of ball bearings such as 70. This is more clearly illustrated in FIG. 4 wherein a cross-sectional view of the spline shaft 58 within the cylindrical collar 68 is generally shown. The cylindrical collar 68 is seen to include three separate recesses 72, 74 and 76, each of which has a paired set of ball bearings such as 70 and 80. Each set of ball bearings is maintained within the respective recess by a retaining ring 82. The spline shaft 58 comprises three separate splines 84, 86, and 88 which are respectively supported by the paired sets of ball bearings. It is to be appreciated that a rotation of the spline shaft 58 will impart a rotation to the cylindrical collar 58. As is partially illustrated in FIG. 4, the cylindrical collar 68 is keyed to a casing 90 via a keyway arrangement 92. The casing 90 is more fully depicted in FIG. 3 and is seen to include the pinion gear 56 at its front end. The casing 90 and the pinion gear 56 will rotate with the cylindrical collar 68 when the same is rotatably driven by the spline shaft 58. The casing 90 will furthermore rotate relative to the lower portion 60 of the beam structure 22 by virtue of a pair of ball bearing mounts 94 and 96.

As has been previously described, the pinion gear 56 engages the rack 54 of the carriage 18. A rotation of the pinion gear 56 will move the rack 54 linearly so as to thereby move the carriage along the length of the cylindrical axis member 20. This movement of the carriage may be effected while the lightweight frame is also being displaced along the length of the rotating shaft 58.

Referring now to FIG. 5, an overall top view of the positioning apparatus is illustrated. The Y-shaped configuration of the brace structure 26 within the lightweight frame is particularly illustrated. The relationship of the various positioning elements can also be appreciated. In this regard, the parallel relationship of the guide 28, the shaft 58, the support 34 and the rack 50 is readily apparent.

It is to be appreciated from the above, that a preferred embodiment of a lightweight, rigid and responsive positioning system has been disclosed. This system has been specifically disclosed for use with a sewing machine although the system is equally applicable to other machinery. It is furthermore to be appreciated that alternative structures may be substituted for elements of the positioning system without departing from the scope of the present invention.

What is claimed is:

1. In an automatic sewing machine wherein an article is intermittently positioned relative to a sewing needle, apparatus for positioning the article comprising:

a frame which is mounted for movement in a predefined plane;

a carriage which is mounted for movement on said frame;

means, attached to said carriage, for securely holding the article in the predefined plane of movement for said frame;

means, remote from said frame, for intermittently moving said frame in a first direction; and means, remote from said frame, for intermittently moving said carriage on said frame when said frame is also being moved in the first direction.

2. The apparatus of claim 1 further comprising:

means for mounting said carriage for movement along an axis transverse to the first direction and within the predefined plane of movement for said frame.

3. The apparatus of claim 1 wherein said means for intermittently moving said carriage comprises:

a shaft extending in the direction of movement of said frame, said shaft being rotatably supported within said frame;

means, at one end of said shaft, for driving said carriage in a linear manner; and means, at the opposite end of said shaft, for rotatably driving said shaft.

4. The apparatus of claim 3 wherein said means for driving said carriage in a linear manner comprises:

a rack located on said carriage;

a pinion, mounted on the one end of said shaft, said pinion engaging said rack so as to linearly move said rack upon rotation of said shaft; and means, above said rack, for maintaining said rack in engagement with said pinion.

5. The apparatus of claim 4 further comprising:

means, rotatably connected to said frame, for slidably engaging said shaft so as to allow said frame to move along the length of said shaft.

6. In an automatic sewing machine wherein an article is intermittently positioned relative to a sewing needle, apparatus for positioning the article comprising:

means for holding the article in a predefined plane;

a frame which is mounted for movement along a first axis extending in a first direction within the predefined plane in which the article is being held; and means for mounting said article holding means on a second axis transverse to the first direction, said second axis being within the predefined plane in which the article is being held.

7. The apparatus of claim 6 further comprising: means, remote from said frame, for intermittently moving said article holding means on said second axis.

8. The apparatus of claim 7 wherein said means for intermittently moving said article holding means comprises:

a shaft extending in the first direction of movement of said frame, said shaft being rotatably supported within said frame;

means, at one end of said shaft, for driving said article holding means in a linear manner; and means at the opposite end of said shaft for rotatably driving said shaft.

9. The apparatus of claim 1 further comprising:

means, remote from said frame, for intermittently moving said frame in the first direction; and means, rotatably connected to said frame for slidably engaging said shaft so as to allow said frame to move in the first direction along the length of said shaft.

10. The apparatus of claim 9 further comprising:

means attached to said carriage, for holding the article in the predefined plane of movement for the L-shaped frame.

11. The apparatus of claim 9 further comprising:

means, attached to said carriage, for holding the article in a plane passing through said first and second axes.

12. The apparatus of claim 9 wherein said means for moving said carriage on said L-shaped frame comprises:

a motor remotely located from said L-shaped frame; and means, connected to said motor, for engageably driving the carriage.

13. The apparatus of claim 12 wherein said means, connected to said motor, for engageably driving said carriage comprises:

a shaft extending in the direction of movement of said L-shaped frame, said shaft being rotatably supported within said L-shaped frame; and means, at one end of said shaft, for driving said carriage in a linear manner.

14. Apparatus for positioning an article relative to an operative tool comprising:

a frame which is mounted for movement along an axis in a predefined plane;

a carriage for supportably holding the article;

means for mounting said carriage for movement along a second axis on said frame;

means, remote from said frame, for driving said frame in a first direction, and means, remote from said frame, for moving said carriage on said frame when said frame is also being driven by said frame driving means, said means for moving said carriage comprising:

a shaft extending in the direction of movement of said frame, said shaft being rotatably supported within said frame;

means, at one end of said shaft, for driving said carriage in a linear manner; and means, at the opposite end of said shaft, for rotatably driving said shaft.

15. The apparatus of claim 14 wherein said means for driving said carriage in a linear manner comprises:

a rack located on said carriage;

a pinion, mounted on the one end of said shaft, said pinion engaging said rack so as to linearly move said rack upon rotation of said shaft; and means, above said rack, for maintaining said rack in engagement with said pinion.

16. The apparatus of claim 15 further comprising:

means, rotatably connected to said frame, for slidably engaging said shaft so as to allow said frame to move along the length of said shaft.

17. The apparatus of claim 14 wherein said frame comprises:

an L-shaped structure having a first beam extending in the direction of movement of said frame and having a second beam extending in a direction transverse to the direction of movement of said frame.

18. The apparatus of claim 17 wherein said frame further comprises:

a Y-shaped brace extending between the beams of the L-shaped structure, said Y-shaped brace having one end connected to said first beam and having two ends connected to said second beam.

19. Apparatus for positioning an article relative to an operative tool comprising:

an L-shaped frame which is mounted for movement along an axis in a predefined plane, said axis being aligned with a first leg of said L-shaped frame;

a carriage for supportably holding the article;

means for mounting said carriage for movement along a second axis on said L-shaped frame, said second axis extending in the direction of the second leg of said L-shaped frame;

means, remote from said L-shaped frame, for driving said L-shaped frame in a first direction; and means for moving said carriage along said second axis on said L-shaped frame when said L-shaped frame is also being driven by said frame driving means.

20. The apparatus of claim 19 wherein said means for driving said carriage in a linear manner comprises:

a rack located on said carriage;

a pinion, mounted on the one end of said shaft, said pinion engaging said rack so as to linearly move said rack upon rotation of said shaft; and means, above said rack, for maintaining said rack in engagement with said pinion.

21. The apparatus of claim 20 further comprising:

means, rotatably connected to said L-shaped frame, for slidably engaging said shaft so as to allow said L-shaped frame to move along the length of said shaft.

22. The apparatus of claim 19 further comprising:

a Y-shaped brace extending between the legs of the L-shaped frame, said Y-shaped brace having one end connected to said first leg and having two ends connected to said second leg.

* * * * *